US008859957B2

(12) United States Patent
Ouyang et al.

(10) Patent No.: US 8,859,957 B2
(45) Date of Patent: Oct. 14, 2014

(54) SYSTEMS AND METHODS FOR SAMPLE ANALYSIS

(75) Inventors: Zheng Ouyang, West Lafayette, IN (US); Robert Graham Cooks, West Lafayette, IN (US); Keyong Hou, Dalian (CN)

(73) Assignee: Purdue Research Foundation, West Lafayette, IN (US)

( * ) Notice: Subject to any disclaimer, the term of this patent is extended or adjusted under 35 U.S.C. 154(b) by 123 days.

(21) Appl. No.: 13/576,483

(22) PCT Filed: Feb. 25, 2011

(86) PCT No.: PCT/US2011/026261

§ 371 (c)(1), (2), (4) Date: Feb. 27, 2013

(87) PCT Pub. No.: WO2011/106656

PCT Pub. Date: Sep. 1, 2011

(65) Prior Publication Data

US 2013/0146759 A1 Jun. 13, 2013

Related U.S. Application Data

(60) Provisional application No. 61/308,459, filed on Feb. 26, 2010.

(51) Int. Cl.

| | |
|---|---|
| ***H01J 49/00*** | (2006.01) |
| ***H01J 49/26*** | (2006.01) |
| ***H01J 49/24*** | (2006.01) |
| ***H01J 49/04*** | (2006.01) |

(52) U.S. Cl.

CPC ..... *H01J 49/26* (2013.01); *H01J 49/0027* (2013.01); *H01J 49/24* (2013.01); *H01J 49/0495* (2013.01)

USPC ..... 250/288; 250/281; 250/282

(58) Field of Classification Search

CPC ... H01J 49/0445; H01J 49/0495; H01J 49/24; G01N 30/72

USPC ..... 250/281, 282, 283, 288, 289

See application file for complete search history.

(56) References Cited

U.S. PATENT DOCUMENTS

| | | | | |
|---|---|---|---|---|
| 7,335,897 | B2 | 2/2008 | Takats et al. | |
| 8,304,718 | B2 | 11/2012 | Ouyang et al. | |
| 2009/0090858 | A1 * | 4/2009 | Musselman | 250/282 |
| 2009/0309015 | A1 * | 12/2009 | Schultz et al. | 250/281 |

FOREIGN PATENT DOCUMENTS

| | | | |
|---|---|---|---|
| WO | 2009/023361 | A2 | 2/2009 |
| WO | 2009/102766 | A1 | 8/2009 |

OTHER PUBLICATIONS

Gao et al., Breaking the Pumping Speed Barrier in Mass Spectrometry: Discontinuous Atmospheric Pressure Interface, Jun. 1, 2008, Analytical Chemistry, vol. 80, No. 11, pp. 4026-4032.*

Carroll et al., Anal. Chem. 47:2369-2373, 1975.

(Continued)

*Primary Examiner* — Nicole Ippolito
*Assistant Examiner* — Hanway Chang
(74) *Attorney, Agent, or Firm* — Brown Rudnick LLP; Adam M. Schoen

(57) ABSTRACT

The invention generally relates to improved sensitivity and flexibility for mass spectrometers with limited pumping capacity, particularly mass spectrometers that are coupled with a Discontinuous Atmospheric Pressure Interface (DAPI).

19 Claims, 14 Drawing Sheets

(56) References Cited

OTHER PUBLICATIONS

Chen, H.; Zheng, X. B.; Cooks, R. G. Journal of the American Society for Mass Spectrometry 2003, 14, 182-188.
Cody et al., Anal. Chem., 77:2297-2302, 2005.
Fenn et al., Science, 246:64-71, 1989.
Gao, L.; Sugiarto, A.; Harper, J. D.; Cooks, R. G.; Ouyang, Z. Anal Chem 2008, 80, 7198-7205.
Harper, J. D.; Charipar, N. A.; Mulligan, C. C.; Zhang, X. R.; Cooks, R. G.; Ouyang, Z. Analytical Chemistry 2008, 80, 9097-9104.
Kaiser, R. E.; Cooks, R. G.; Syka, J. E. P.; Stafford, G. C. Rapid Communications in Mass Spectrometry 1990, 4, 30-33.
Kogelschatz, Plasma Chemistry and Plasma Processing, 23:1-46, 2003.
Laiko et al. Anal. Chem., 72:652-657, 2000.
Laughlin, B. C.; Mulligan, C. C.; Cooks, R. G. Analytical Chemistry 2005, 77, 2928-2939.
Lin, B.; Sunner, J. Journal of the American Society for Mass Spectrometry 1994, 5, 873-885.
Louris, J. N.; Cooks, R. G.; Syka, J. E. P.; Kelley, P. E.; Stafford, G. C.; Todd, J. F. J. Analytical Chemistry 1987, 59, 1677-1685.
Riter, L. S.; Meurer, E. C.; Handberg, E. S.; Laughlin, B. C.; Chen, H.; Patterson, G. E.; Eberlin, M. N.; Cooks, R. G. Analyst 2003, 128, 1112-1118.
Schwartz, J. C.; Jaardine, I. Rapid Communications in Mass Spectrometry 1992, 6, 313-317.
Shaffer, S. A.; Tang, K. Q.; Anderson, G. A.; Prior, D. C.; Udseth, H. R.; Smith, R. D. Rapid Communications in Mass Spectrometry 1997, 11, 1813-1817.
Shiea et al., J. Rapid Communications in Mass Spectrometry, 19:3701-3704, 2005.
Takats et al., Science, 306:471-473, 2004.
Tanaka et al. Rapid Commun. Mass Spectrom., 2:151-153, 1988.
Xu, W.; Song, Q.; Smith, S. A.; Chappell, W. J.; Ouyang, Z. J Am Soc Mass Spectrom 2009, 20, 2144-2153.
Yamashita et al., J. Phys. Chem., 88:4451-4459, 1984.

* cited by examiner

MS configurations with continuous atmospheric pressure interface.

MS configurations with discontinuous atmospheric pressure interface.

The pressure variation within an operation cycle of the DAPI.

The pressure variation for MS analysis at mTorr range with DAPI for ion introduction.

Schematic of the pumping system of a mass spectrometer with a long probe and a DAPI.

The experimental setup, DAPI capillary 500 µm ID and ~10 cm long

Spectrum recorded for DEET in air using the setup shown in b) and APCI (corona discharge).

Voltage control for operating the pinch valve. The voltage is switched between an elevated voltage, instead of ground, and a higher voltage.

SYSTEMS AND METHODS FOR SAMPLE ANALYSIS

RELATED APPLICATION

The present application is a 35 U.S.C. §371 national phase application and claims the benefit of and priority to PCT/US11/26261, filed Feb. 25, 2011, which claims the benefit of and priority to U.S. provisional application No. 61/308,459, filed Feb. 26, 2010, the content of each of which is incorporated by reference herein in its entirety.

FIELD OF THE INVENTION

The invention generally relates to improved sensitivity and flexibility for mass spectrometers with limited pumping capacity, particularly mass spectrometers that are coupled with a Discontinuous Atmospheric Pressure Interface (DAPI).

BACKGROUND

For ion trap type mass spectrometers, the pumping capability is not efficiently used with a traditional constantly open API. The ions are usually allowed to pass into the ion trap for only part of each scan cycle but neutrals are constantly leaked into the vacuum manifold and need to be pumped away to keep the pressure at the low levels typically needed for mass analysis. Although the mass analysis using an ion trap usually requires an optimal pressure at several milli-torr or less, ions can be trapped at a much higher pressure. (Shaffer, S. A.; Tang, K. Q.; Anderson, G. A.; Prior, D. C.; Udseth, H. R.; Smith, R. D. *Rapid Communications in Mass Spectrometry* 1997, 11, 1813-1817).

Taking advantage of this characteristic of an ion trap, an alternative atmospheric pressure interface, a discontinuous atmospheric pressure interface (DAPI), has been developed to allow maximum ion transfer at a given pumping capacity for mass spectrometers containing an ion trapping component (Ouyang et al., U.S. patent application Ser. No. 12/622,776 and PCT application number PCT/US2008/065245). The concept of DAPI is to open its channel during ion introduction and then close it for subsequent mass analysis during each scan. An ion transfer channel with a much bigger flow conductance can be allowed for a DAPI than for a traditional continuous API. The pressure inside the manifold temporarily increases significantly when the channel is opened for maximum ion introduction. All high voltages can be shut off and only low voltage RF is on for trapping of the ions during this period. After the ion introduction, the channel is closed and the pressure can decrease over a period of time to reach the optimal pressure for further ion manipulation or mass analysis when the high voltages can be is turned on and the RF can be scanned to high voltage for mass analysis.

A discontinuous API opens and shuts down the airflow in a controlled fashion. The pressure inside the vacuum manifold increases when the API opens and decreases when it closes. The combination of a discontinuous atmospheric pressure interface with a trapping device, which can be a mass analyzer or an intermediate stage storage device, allows maximum introduction of an ion package into a system with a given pumping capacity.

SUMMARY

It has now been discovered that a discontinuous atmospheric pressure interface (DAPI) allows for use of vacuum manifolds that have an increased volume compared to those found in typical mass spectrometers that use a constantly open API. In fact, it has been surprisingly discovered that increasing the volume of the vacuum manifold used with a DAPI increases the efficiency of ion transfer into a mass analyzer, rather than decreasing the efficiency of ion transfer, as is observed when the volume of the vacuum manifold is increased for a mass spectrometer that uses a constantly open API. In fact, mass spectrometers that use constantly open APIs are designed to have as small a manifold as possible to minimize strain on pumps and to increase efficiency of ion transfer. Increasing the volume of the vacuum manifold does not benefit a mass spectrometer with a constantly open API. Increasing the volume of the vacuum manifold with a DAPI allows for a greater amount of gas, and thus ions, to enter the mass spectrometer, thus increasing the amount of ions that may be transferred to the mass analyzer.

In certain aspects, the invention provides a method for increasing the sensitivity of a mass spectrometer equipped with a discontinuous atmospheric pressure interface, involving increasing vacuum volume of the mass spectrometer equipped with the discontinuous atmospheric pressure interface. Increasing the vacuum volume may be achieved in numerous different manners. In one embodiment, the larger volume is achieved by using an elongated tube, such as a flexible tube. This configuration may be used to construct a sampling wand.

Methods of the invention further involve analyzing a sample. Any mass spectrometry technique known in the art may be used with methods of the invention to analyze the sample. Exemplary mass spectrometry techniques that utilize ionization sources at atmospheric pressure for mass spectrometry include electrospray ionization (ESI; Fenn et al., Science, 246:64-71, 1989; and Yamashita et al., J. Phys. Chem., 88:4451-4459, 1984); atmospheric pressure ionization (APCI; Carroll et al., Anal. Chem. 47:2369-2373, 1975); and atmospheric pressure matrix assisted laser desorption ionization (AP-MALDI; Laiko et al. Anal. Chem., 72:652-657, 2000; and Tanaka et al. Rapid Commun. Mass Spectrom., 2:151-153, 1988). The content of each of these references in incorporated by reference herein its entirety.

Exemplary mass spectrometry techniques that utilize direct ambient ionization/sampling methods including desorption electrospray ionization (DESI; Takats et al., Science, 306:471-473, 2004 and U.S. Pat. No. 7,335,897); direct analysis in real time (DART; Cody et al., Anal. Chem., 77:2297-2302, 2005); Atmospheric Pressure Dielectric Barrier Discharge Ionization (DBDI; Kogelschatz, Plasma Chemistry and Plasma Processing, 23:1-46, 2003, and PCT international publication number WO 2009/102766), and electrospray-assisted laser desoption/ionization (ELDI; Shiea et al., J. Rapid Communications in Mass Spectrometry, 19:3701-3704, 2005). The content of each of these references in incorporated by reference herein its entirety.

The mass spectrometer includes a mass analyzer. The mass analyzer may be a quadrupole ion trap, a rectalinear ion trap, a cylindrical ion trap, a ion cyclotron resonance trap, and an orbitrap.

Discontinuous atmospheric interfaces are described in (Ouyang et al., U.S. patent application Ser. No. 12/622,776 and PCT application number PCT/US2008/065245), the content of each of which is incorporated by reference herein in its entirety. In certain embodiments, the discontinuous atmospheric interface includes a valve for controlling entry of ions into the trapping device such that the ions are transferred into the trapping device in a discontinuous mode. Any valve known in the art may be used. Exemplary valves include a pinch valve, a thin plate shutter valve, or a needle valve.

In certain embodiments, the discontinuous atmospheric pressure interface may further include a tube, in which an exterior portion of the tube is aligned with the valve, and a first capillary inserted into a first end of the tube and a second capillary inserted into a second end of the tube, such that neither the first capillary nor the second capillary overlap with a portion of the tube that is in alignment with the valve. In certain embodiments, the atmospheric pressure interface further includes a tube, in which an exterior portion of the tube is aligned with the valve.

Another aspect of the invention provides a mass spectrometer equipped with a discontinuous atmospheric pressure interface having increased sensitivity produced by the process of increasing vacuum volume of the mass spectrometer equipped with the discontinuous atmospheric pressure interface.

DETAILED DESCRIPTION

The ion transfer efficiency from atmosphere to a vacuum chamber through a capillary strongly depends on the mass flow rate. Normally, a higher mass flow rate results in higher ion transfer efficiency. The space charge and diffusion induced ion losses on the capillary walls are the major ion losses during the ion transfer process. Based on Fick's law of diffusion and the continuity of ion density, the ions' decay time (τ) for the fundamental diffusion mode is a function of the conductance of the capillary (C): $\tau \sim \sqrt{C}$. The ions' decay time indicates the lifetime of ions in the gas flow; or in other words, the ion transfer efficiency of the capillary. The conductance of the capillary is also proportional to the mass flow rate (n') (Equation 1). Therefore, a higher mass flow rate leads to a higher ion transfer efficiency.

Figure 1A:
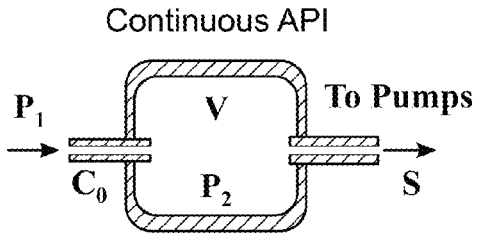
FIG. 1 is a set of diagrams showing MS configurations with continuous (a) and discontinuous (b) atmospheric pressure interface. Panel C shows the pressure variation within a operation cycle of the DAPI. Panel D shows the pressure variation for MS analysis at mTorr range with DAPI for ion introduction.

For a continuous vacuum interface as shown in FIG. 1*a*, the mass flow rate into the chamber needs to be balanced by the effective pumping speed (S) of the pumping system. The mass flow rate (n') is a function of the pressure difference ($P_1-P_2$) and the conductance (C) of the interface $$n' = \frac{dn}{dt} = \frac{(P_1 - P_2)C}{RT} = S. \qquad \text{Equation 1}$$

where n is the amount of gas, R is gas constant and T is the absolute temperature. With an effective pumping speed of the pumping system restricted by the pumps, the continuous atmospheric pressure interfaces typically have multiple stages of differential pumping with relatively small pressure difference between each of the two stages (multiple pressure stages to achieve high pressure difference) or have interfaces with small conductance. After the initial pumping down process, the total amount of gas introduced into the chamber is a function of time and the pumping speed, but is independent on the volume (V) of the vacuum chamber.

Figure 1B:
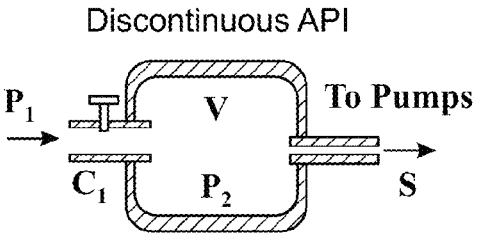
Figure 1C:
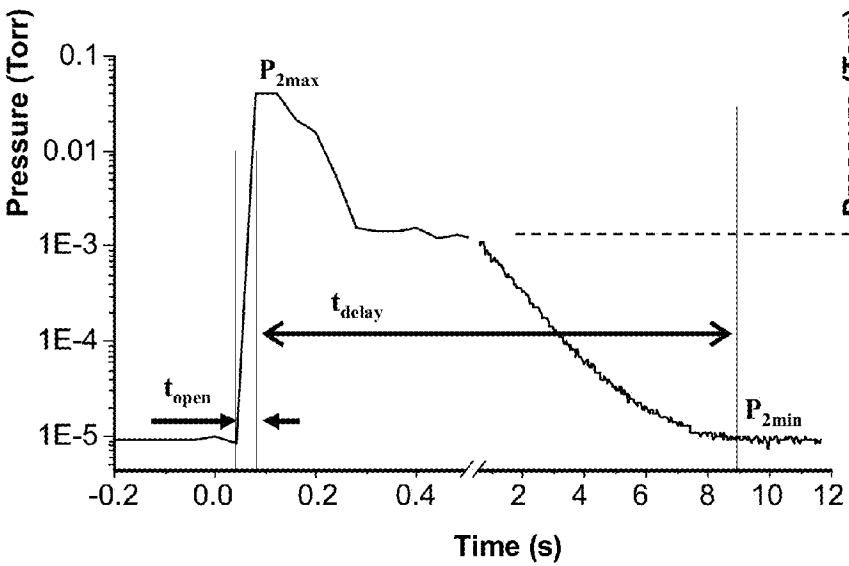

During the short DAPI open period (FIG. 1*c*), the pressure inside the vacuum chamber will bounce high due to the high gas flow rate and the pressure drop due to the pumping system can be ignored. FIG. 1*c* also shows the pressure variation of one cycle of DAPI operation. Based on the ideal gas law (Equation 2), a larger vacuum chamber will allow a larger volume of gas to be injected into the vacuum chamber before the maximum allowed pressure.

$$n = \frac{(P_{2max} - P_{2min})V}{RT} \qquad \text{Equation 2}$$

$P_{max}$ is the maximum allowed pressure inside the chamber by the pumping system (normally 50-100 mTorr), $P_{2min}$ is the lowest pressure of the chamber (several mTorr or lower), at which the mass analysis is done. Since $P_{2min}$ is much smaller than $P_{2max}$, $$n = \frac{(P_{2max} - P_{2min})V}{RT} \approx \frac{P_{2max}V}{RT} \qquad \text{Equation 3}$$

The average flow rate n' is $$n' = \frac{P_{2max}}{RT}\frac{V}{\Delta t} \qquad \text{Equation 4}$$

where Δt is the open time for the pinch valve. Several important conclusions can be drawn from Equations 3 for the ion transfer with a DAPI: the flow rate and the introduced gas amount are independent of the pumping speed, which is completely different from vacuum systems using continuous atmospheric pressure interface; the flow rate is proportional to the volume of the vacuum manifold; and the flow rate is proportional to the highest pressure during the opening of the DAPI.

Figure 1D:
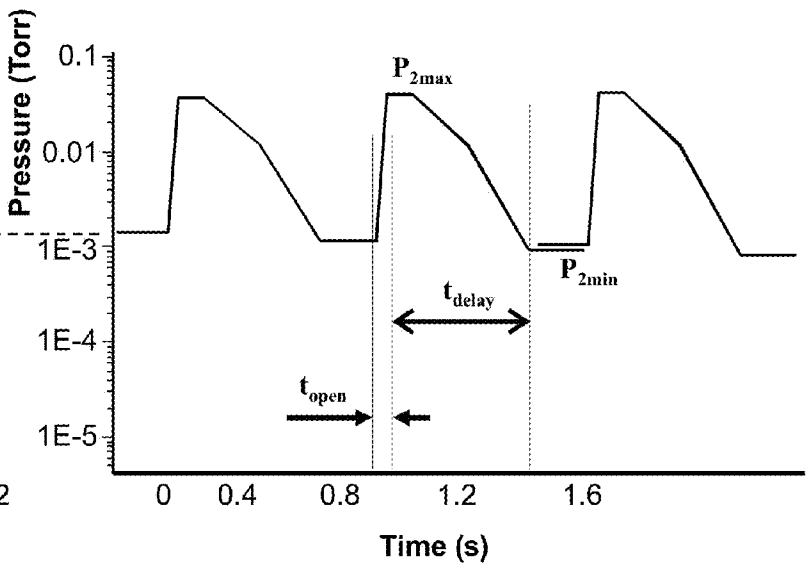

The maximum pressure during the DAPI opening is determined by the MS analysis procedure. The concept of using DAPI for MS analysis involves trapping the ions during ion introduction then mass analyzing the ions after the pressure decreases. The maximum pressure allows ions to be trapped efficiently is about 1 Torr or below. With a larger vacuum manifold used for DAPI (FIG. 1*b*), a higher efficiency of ion transfer is gained. Generally, with use of the larger manifold, a longer delay is required for the pressure to decrease to a target value for MS analysis (FIG. 1*d*). The delay time is dependent on the pumping speed and the MS analysis pressure $P_{2min}$.

$$t = \frac{V}{S}\ln\left(\frac{P_{2max}}{P_{2min}}\right) \qquad \text{Equation 5}$$

As shown in FIGS. 1*c* and *d*, the delay time between the shutoff of the valve and the MS analysis can be significantly shortened if the MS analysis is performed at a higher pressure, such as several millitorrs.

In a test of the DAPI instrument configurations, a vacuum manifold 35×25×25 $cm^3$ with a DAPI was coupled with several pumping systems. Several capillaries of different IDs were used for DAPI conductance restriction, including 125 mm, 250 mm, 1 mm and 1.5 mm, all of the same length (10 cm). Three different pumping systems of different combinations of turbo and roughing pumps were tested, including a 30 $m^3$/h roughing pump (Pfeiffer UNO-030M) together with a 345 l/s turbo pump (TurboVac 361), a 307 $m^3$/h roughing pump (Edwards 275 E2M275) together with a 345 l/s turbo pump, and a 307 $m^3$/h roughing pump together with two turbo pumps, 345 l/s and 2101/s (Pfeiffer TMH262P). For all the tests, the pinch valve was opened for 15 ms. Then the pressure inside the vacuum chamber was monitored by a MKS 925C microPirani transducer (MKS Instrument, Andover, Mass.). Measured results showed that pressure variations during each cycle of the DAPI operation were similar for the three types of pumping systems.

Figure 2A:
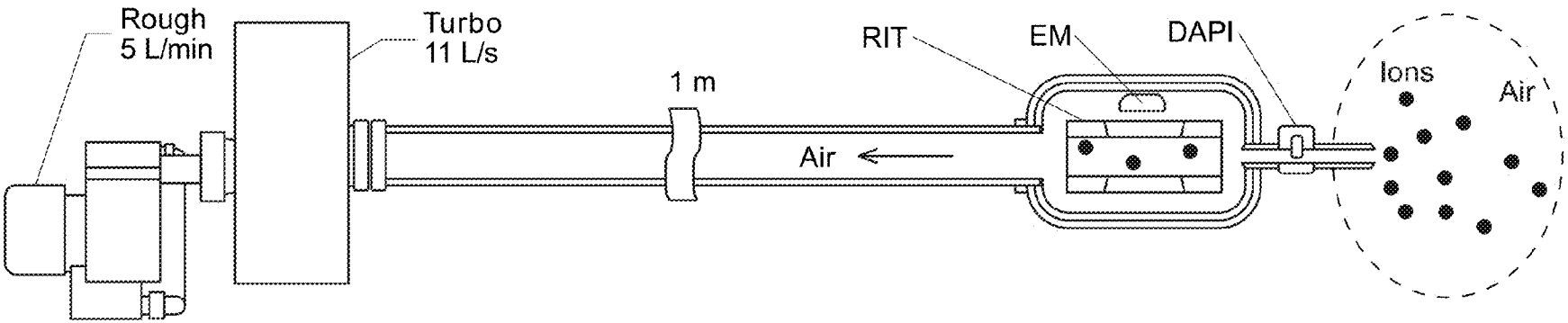
FIG. 2*a* is a schematic of a pumping system of a mass spectrometer with a long probe and a DAPI.

The design of a MS configuration with a DAPI and an enlarged vacuum manifold is shown in FIG. 2*a*. The ion trap mass analyzer is installed close to the DAPI and the vacuum manifold is extended with a flexible tube between the mass analyzer and the pumping system. The ions, generated by electrospray ionization (ESI), atmospheric pressure chemical ionization (APCI), desorption electrospray ionization (DESI), low temperature plasma (LTP) probe, or other ionization methods, are transferred with air though the DAPI. All the ions and air molecules will pass the trapping device located immediately after the DAPI, where the ions are retained in the trap while the air is pumped away. The trapping device acts as a ion filtering device.

In certain embodiments, an APCI (corona discharge) ionization source, the DAPI, a rectilinear ion trap, the ion multiplier and the RF coil are positioned in a hand-held probe. The pumping system consists of a miniature rough pump and a miniature turbopump with pumping speeds of 5 L/min and 10 L/s, respectively. A 1 meter long, 25 mm diameter stainless bellows is used to connect the hand-held probe with a backpack unit.

The pressure variation inside the vacuum chamber has been tested. When the pinch valve opens for 15 ms with a cycling period of 1.2 s, the pressure was found to vary from $1\times10^{-3}$ to $1\times10^{-1}$ Torr for the new system but it was $4\times10^{-4}$ to 1 Torr for the Mini 11. Small volume chambers reach higher pressures than large vacuum chambers and transient high pressure in the vacuum chamber can damage the turbo pump. These results show that, under the same transient high vacuum pressure, large vacuum system volumes permit a longer pinch valve open time.

Saturated vapor pressure of deet pestanal (C12H17NO, MW: 191.27) was used as a sample. Data show that a signal as high as 6.2V was obtained (FIG. 2*c*). The RF frequency was 1.15 MHz and the voltage was 3.5 kV (peak to peak) with 100 ms scan time. The detector voltage was 1900V for 100 ms and the pinch valve opening time was 18 ms. The cooling time between pinch valve open time and RF scan time was 1 s. The end cap voltage was 215.8 V.

Figure 2B:
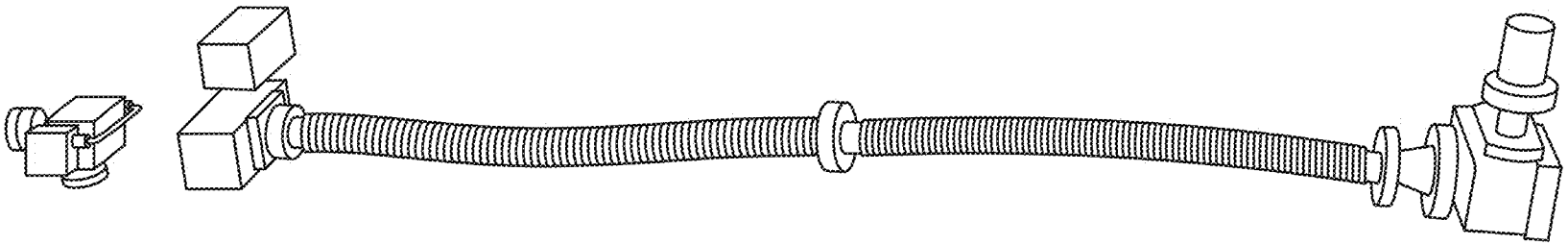
FIG. 2*b* shows the experimental setup, DAPI capillary 500 μm ID and ~10 cm long.
Figure 2C:
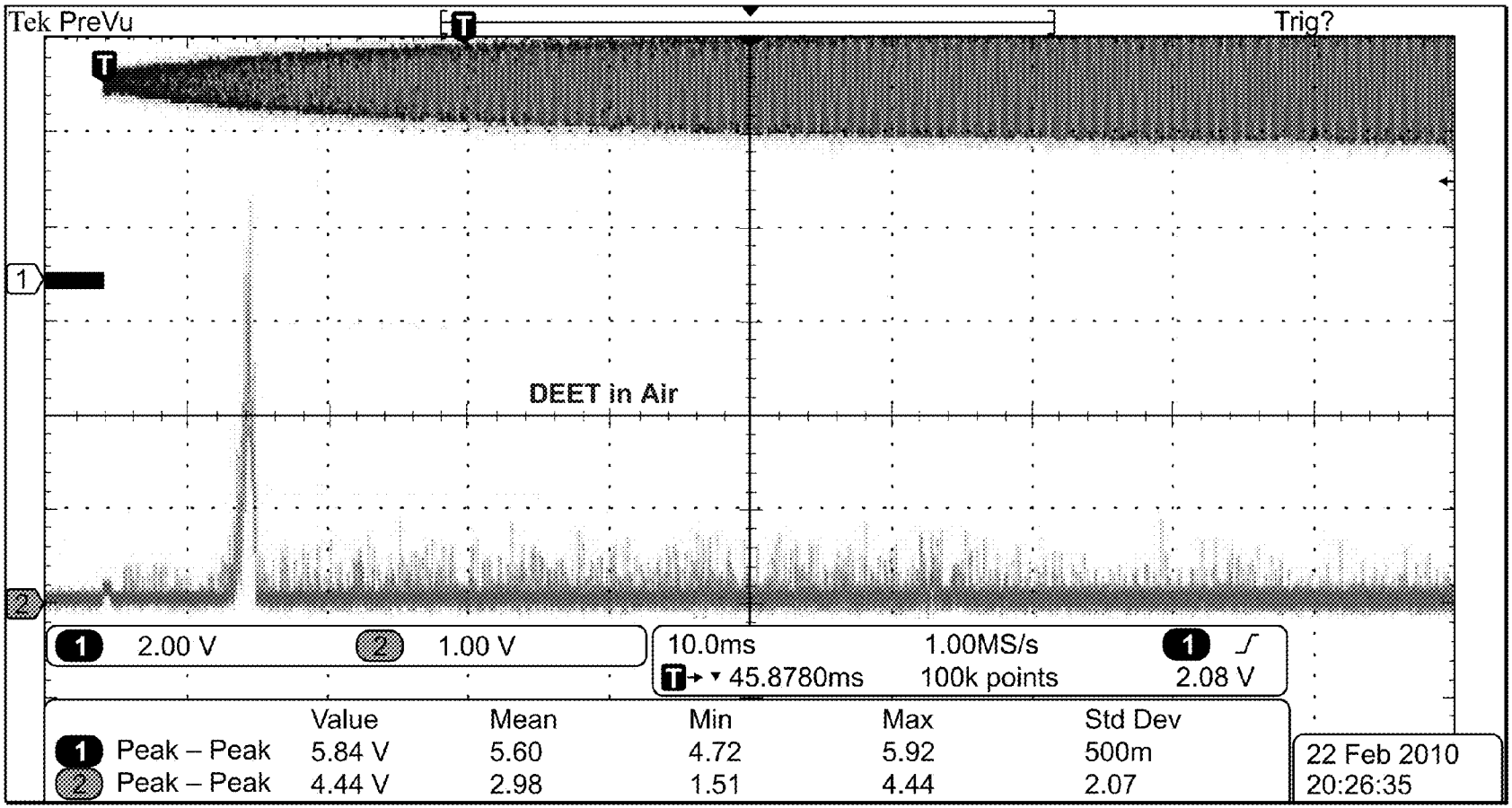
FIG. 2*c* shows spectrum recorded for DEET in air using the setup shown in b) and APCI (corona discharge).
Figure 3:
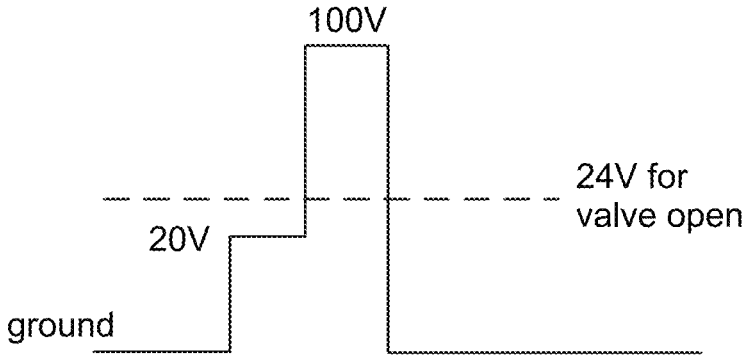
FIG. 3 is a diagram showing voltage control for operating the pinch valve. The voltage is switched between an elevated voltage, instead of ground, and a higher voltage.

Instead of switching between ground and 24 V for opening and shutting of the pinch valve, a control method shown in FIG. 2 was used to improve the speed of the opening the pinch valve. The pinch valve control voltage was raised from ground to a elevated level before it is set to open and subsequently it is raised to a higher voltage at the time of opening. This allows an improvement of the response time for pinch valve opening from 10 ms to about 1 ms. Capillaries with larger IDs can now be used to allow larger conductance for transferring ions while keeping the total amount of air introduced constant.

Figure 4:
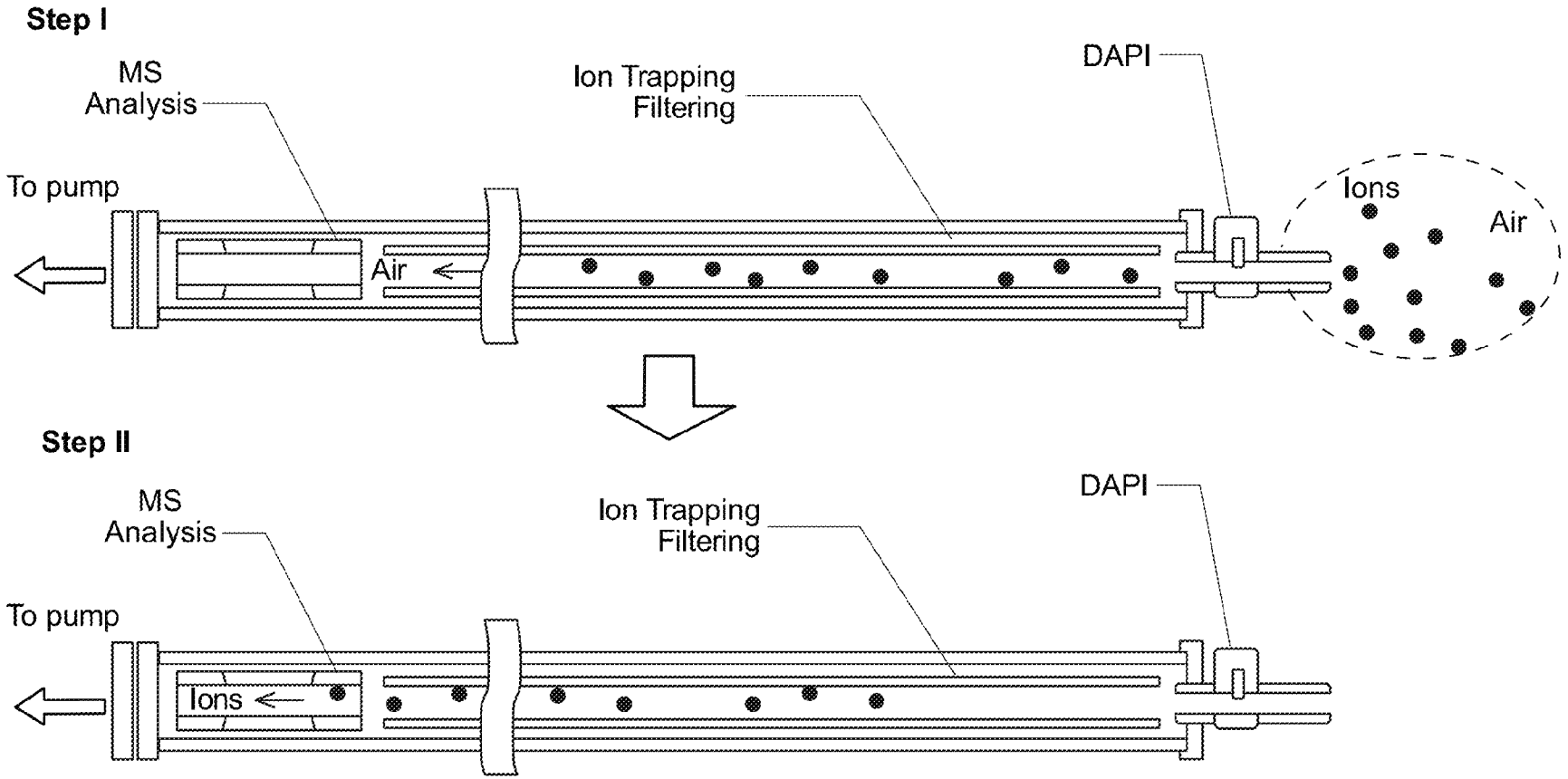
FIG. 4 is a diagram showing long ion trapping device can be installed between the DAPI and the mass analysis device.

As shown in FIG. 4, a long ion trapping device can be installed between the DAPI and the mass analysis device. The ion trapping device can be a linear quadrupole, octopole or hexapole trap. The ion trapping device can be segmented or flexible. The DC voltage gradient along the trapping device can be adjusted. When the DAPI is opened, the air carrying ions will go through the long trapping device, where the ions will trapped and retained while the air is pumped away. This can be repeated several times to allow large amount of the ions to be accumulated. The elongated trapping field will improve the efficiency of trapping the ions in the high velocity gas flow through the DAPI. After the ion filtering and trapping step, the ions can be transferred to a mass analyzer for MS analysis or for other gas phase ion processes. Multiple probes, each with a DAPI and long ion filtering device can be used to collection ions of the same or different types and send them to the same mass analyzer for MS analysis or gas phase reactions.

Discontinuous Atmospheric Pressure Interface (DAPI)

Discontinuous atmospheric interfaces are described in (Ouyang et al., U.S. patent application Ser. No. 12/622,776 and PCT application number PCT/US2008/065245), the content of each of which is incorporated by reference herein in its entirety.

The concept of the DAPI is to open its channel during ion introduction and then close it for subsequent mass analysis during each scan. An ion transfer channel with a much bigger flow conductance can be allowed for a DAPI than for a traditional continuous API. The pressure inside the manifold temporarily increases significantly when the channel is opened for maximum ion introduction. All high voltages can be shut off and only low voltage RF is on for trapping of the ions during this period. After the ion introduction, the channel is closed and the pressure can decrease over a period of time to reach the optimal pressure for further ion manipulation or mass analysis when the high voltages can be is turned on and the RF can be scanned to high voltage for mass analysis.

A DAPI opens and shuts down the airflow in a controlled fashion. The pressure inside the vacuum manifold increases when the API opens and decreases when it closes. The combination of a DAPI with a trapping device, which can be a mass analyzer or an intermediate stage storage device, allows maximum introduction of an ion package into a system with a given pumping capacity.

Much larger openings can be used for the pressure constraining components in the API in the new discontinuous introduction mode. During the short period when the API is opened, the ion trapping device is operated in the trapping mode with a low RF voltage to store the incoming ions; at the same time the high voltages on other components, such as conversion dynode or electron multiplier, are shut off to avoid damage to those device and electronics at the higher pressures. The API can then be closed to allow the pressure inside the manifold to drop back to the optimum value for mass analysis, at which time the ions are mass analyzed in the trap or transferred to another mass analyzer within the vacuum system for mass analysis. This two-pressure mode of operation enabled by operation of the API in a discontinuous fashion maximizes ion introduction as well as optimizing conditions for the mass analysis with a given pumping capacity.

The design goal is to have largest opening while keeping the optimum vacuum pressure for the mass analyzer, which is between $10^{-3}$ to $10^{-10}$ torr depending the type of mass analyzer. The larger the opening in an atmospheric pressure interface, the higher is the ion current delivered into the vacuum system and hence to the mash analyzer.

Figure 5:
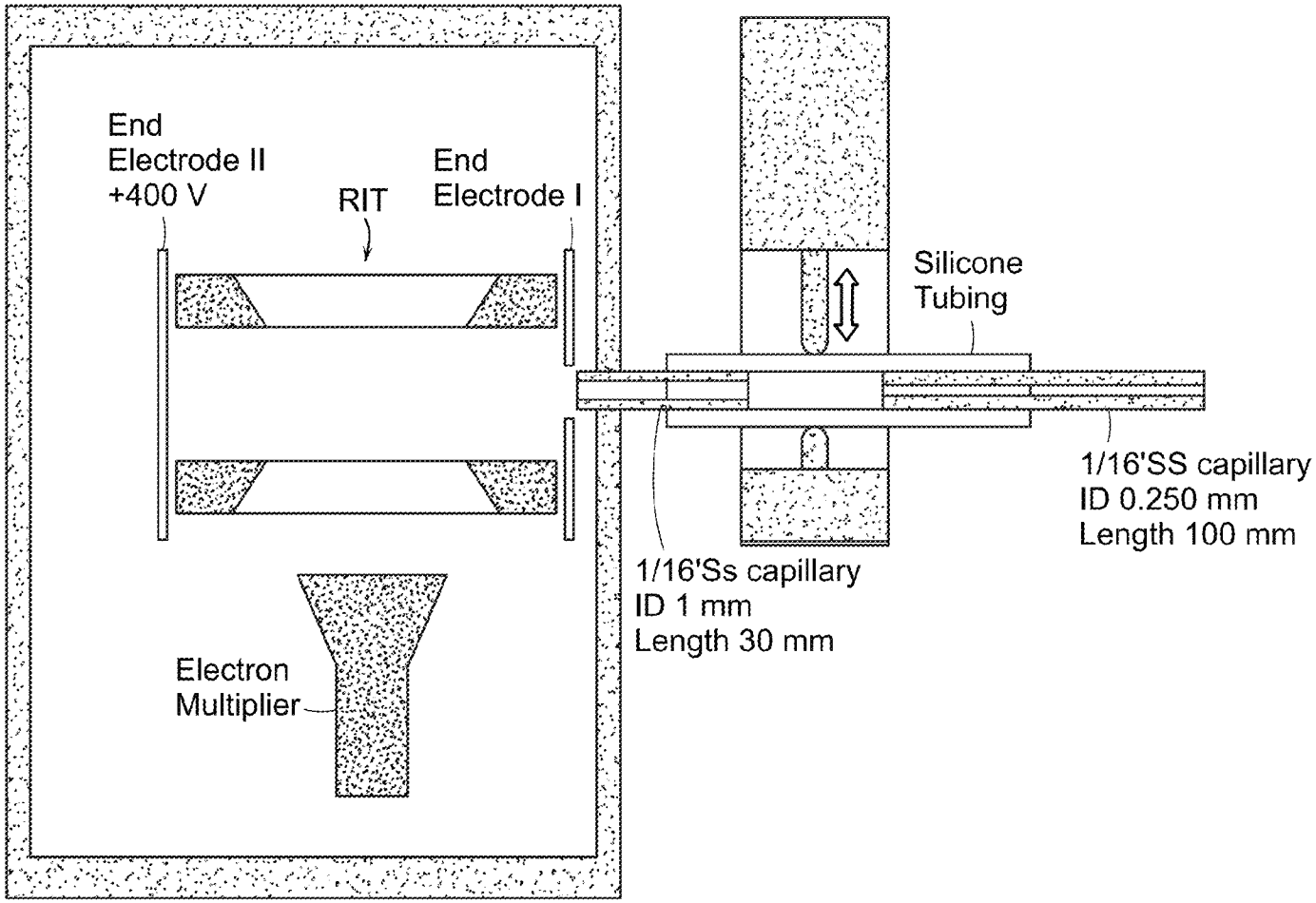
FIG. 5 is a diagram showing an exemplary embodiment of a discontinuous atmospheric interface coupled to a mass analyzer.

An exemplary embodiment of a DAPI is shown in FIG. 5. The DAP includes a pinch valve that is used to open and shut off a pathway in a silicone tube connecting regions at atmospheric pressure and in vacuum. A normally-closed pinch valve (390NC24330, ASCO Valve Inc., Florham Park, N.J.) is used to control the opening of the vacuum manifold to atmospheric pressure region. Two stainless steel capillaries are connected to the piece of silicone plastic tubing, the open/closed status of which is controlled by the pinch valve. The stainless steel capillary connecting to the atmosphere is the flow restricting element, and has an ID of 250 μm, an OD of 1.6 mm (1/16") and a length of 10 cm. The stainless steel capillary on the vacuum side has an ID of 1.0 mm, an OD of 1.6 mm (1/16") and a length of 5.0 cm. The plastic tubing has an ID of 1/16", an OD of 1/8" and a length of 5.0 cm. Both stainless steel capillaries are grounded. The pumping system of the mini 10 consists of a two-stage diaphragm pump 1091-N84.0-8.99 (KNF Neuberger Inc., Trenton, N.J.) with pumping speed of 5 L/min (0.3 $m^3$/hr) and a TPD011 hybrid turbomolecular pump (Pfeiffer Vacuum Inc., Nashua, N.H.) with a pumping speed of 11 L/s.

When the pinch valve is constantly energized and the plastic tubing is constantly open, the flow conductance is so high that the pressure in vacuum manifold is above 30 torr with the diaphragm pump operating. The ion transfer efficiency was measured to be 0.2%, which is comparable to a lab-scale mass spectrometer with a continuous API. However, under these conditions the TPD011 turbomolecular pump can not be turned on. When the pinch valve is de-energized, the plastic tubing is squeezed closed and the turbo pump can then be turned on to pump the manifold to its ultimate pressure in the range of $1\times10^{-5}$ torr.

The sequence of operations for performing mass analysis using ion traps usually includes, but is not limited to, ion introduction, ion cooling and RF scanning. After the manifold pressure is pumped down initially, a scan function is implemented to switch between open and closed modes for ion introduction and mass analysis. During the ionization time, a 24 V DC is used to energize the pinch valve and the API is open. The potential on the rectilinear ion trap (RIT) end electrode is also set to ground during this period. A minimum response time for the pinch valve is found to be 10 ms and an ionization time between 15 ms and 30 ms is used for the characterization of the discontinuous API. A cooling time between 250 ms to 500 ms is implemented after the API is closed to allow the pressure to decrease and the ions to cool down via collisions with background air molecules. The high voltage on the electron multiplier is then turned on and the RF voltage is scanned for mass analysis. During the operation of the discontinuous API, the pressure change in the manifold can be monitored using the micro pirani vacuum gauge (MKS 925C, MKS Instruments, Inc. Wilmington, Mass.) on Mini 10.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

The invention may be embodied in other specific forms without departing from the spirit or essential characteristics thereof. The foregoing embodiments are therefore to be considered in all respects illustrative rather than limiting on the invention described herein. Scope of the invention is thus indicated by the appended claims rather than by the foregoing description, and all changes which come within the meaning and range of equivalency of the claims are therefore intended to be embraced therein.

EXAMPLES

A new sampling wand concept for ion trap mass spectrometers equipped with discontinuous atmospheric pressure interfaces (DAPI) has been implemented. The ion trap/DAPI combination facilitates the operation of miniature mass spectrometers equipped with ambient ionization sources. However, in the new implementation, instead of transferring ions pneumatically from a distant source, the mass analyzer and DAPI are separated from the main body of the mass spectrometer and installed at the end of a 1.2 m long wand. During ion introduction, ions are captured in the ion trap while the gas in which they are contained passes through the probe and is pumped away. The larger vacuum volume due to the extended wand improves the mass analysis sensitivity. The wand was tested using a modified handheld ion trap mass spectrometer without additional power or pumping required. Improved sensitivity was obtained as demonstrated with nano-ESI, atmospheric pressure chemical ionization (APCI), and low temperature plasma (LTP) probe analysis of liquid, gaseous and solid samples, respectively.

Examples herein show that a sampling wand for a mass spectrometer system was developed. The design of the wand has particular advantages when used with miniature mass spectrometers, the performance of which is limited by low power and low pumping capacity. The design leverages a unique feature of the DAPI system, viz. that improved sensitivity is obtainable with enlarged vacuum volume. The improved performance of the system was demonstrated with the analysis of liquid, gas and solid samples using nano-ESI, APCI and LTP, in direct comparisons with data taken from an unmodified handheld mass spectrometer. A 1.2 m long sampling wand was utilized without any additional pumping or power demands and a three-fold improvement in sensitivity was achieved for the modified handheld instrument, in comparison with the original Mini 11.

Example 1

Concept and Instrumentation

Figure 6:
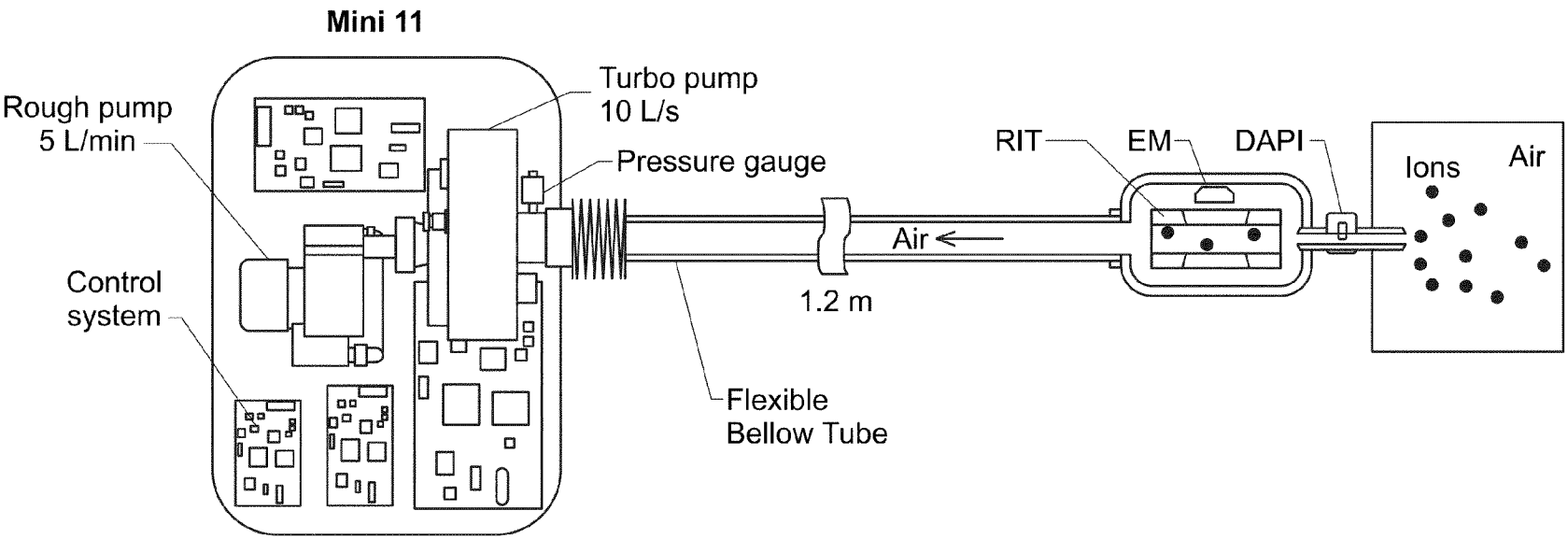
FIG. 6 is a schematic showing a sampling wand coupled with a miniature ion trap mass spectrometer. RIT, rectilinear ion trap; EM, electron multiplier; DAPI, discontinuous atmospheric pressure interface.

A sampling wand configuration for use with an MS system, such as portable MS systems with ambient ionization capabilities, is described herein. By analogy with the backpack vacuum cleaner, a backpack MS configuration optimizes weight distribution and ease of operation. The main weight of the instrument is in the backpack, while the sampling wand is handheld and can easily be swept across surfaces of interest. A schematic design of the wand is shown in FIG. 6. Instead of transferring neutrals and analyte ions over long distances, the ion trap mass analyzer and the DAPI are separated from the pumping system and installed close to the sample. When the DAPI is open, the gas containing ions passes through the ion trap and the ions are trapped while the gas is pumped away. This configuration makes the ion trap act as an ion filter and as an ion concentrator.

This configuration inevitably results in an expanded vacuum volume of the mass spectrometer, which is not desirable in a traditional mass spectrometer system; however, for a miniature instrument with a DAPI, the use of larger vacuum volumes can be advantageous. In a recent study (Xu, W.; Charipar, N.; Kirleis, M.; Xia, Y.; Chappell, W. J.; Ouyang, Z. *Anal. Chem.* 2010, 82, 6584-6592) it was shown via a theoretical derivation that the number of ions introduced into a manifold using a DAPI is proportional to the vacuum volume ($V_{vacuum}$) and the maximum allowable pressure ($P_{max}$) (Equation 6).

$$n = \frac{P_{max} V_{vacuum}}{RT} \quad \text{Equation 6}$$

The manifold of the mass spectrometer fitted with a DAPI serves as a vacuum capacitor, which is "recharged" with gas (n mol) containing ions each time the DAPI opens. The maximum allowable pressure $P_{max}$ of the vacuum is the highest pressure at which ions can be efficiently trapped in an ion trap; this is estimated to be about 1 Torr (Xu, W.; Song, Q.; Smith, S. A.; Chappell, W. J.; Ouyang, Z. *J Am Soc Mass Spectrom* 2009, 20, 2144-2153). A vacuum system of larger volume allows more gas to be introduced via the DAPI before reaching the same pressure. With the same amount of gas introduced into the vacuum, the higher the flow rate, the higher the percentage of ions surviving the transfer step (Lin, B.; Sunner, J. *Journal of the American Society for Mass Spectrometry* 1994, 5, 873-885). Therefore, to introduce more ions for mass analysis, it is preferable to operate the DAPI using a larger capillary instead of a longer opening time.

To test these concepts, a handheld rectilinear ion trap mass spectrometer, Mini 11 (Gao, L.; Sugiarto, A.; Harper, J. D.; Cooks, R. G.; Ouyang, Z. *Anal Chem* 2008, 80, 7198-7205) was modified with a flexible bellow tube (1.2 m long and 25 mm ID, stainless steel) added between the mass analyzer chamber and the turbo pump. The DAPI, the ion trap mass analyzer, and the electron multiplier were moved to the end of the wand, while the pumping, power and control systems were kept in the main body of the instrument. The total vacuum volume was increased by about three times. The original flow restricting capillary (5 cm long, 250 μm ID) used in the Mini 11 was replaced with a 10 cm, 500 μm ID capillary, corresponding to an eight fold increase in flow conductance. Remarkably, the flow conductance was comparable with that of an LTQ mass spectrometer (Thermo Electron, Inc., San Jose, Calif.) with an inlet capillary of 10 cm long and 500 μm ID; however, the pumping system of the Mini 11 is composed of a 10 L/s trubomolecular pump (Pfeiffer HiPace 10, Pfeiffer Vacuum Inc., Nashua, N.H.) and a 5 L/min diaphragm pump (1091-N84.0-8.99, KNF Neuberger Inc., Trenton, N.J.), providing a pumping capacity several hundred times less than that of an LTQ. During the opening period of the DAPI, a relatively low RF amplitude (700 $V_{p-p}$) was used for ion trapping and the high voltage applied to the electron multiplier was turned off; using a delay (ca. 1 s) after the DAPI was closed, the electron multiplier was turned on and the RF amplitude was subsequently ramped for mass analysis.

Example 2

System Set-Up

The sampling wand was tested using several atmospheric pressure and ambient ionization methods, including nano-ESI, atmospheric pressure chemical ionization (APCI), and a low temperature plasma (LTP) probe (Harper, J. D.; Charipar, N. A.; Mulligan, C. C.; Zhang, X. R.; Cooks, R. G.; Ouyang, Z. *Analytical Chemistry* 2008, 80, 9097-9104). The nanospray tips were all pulled from borosilicate glass capillaries (1.5 mm o.d. and 0.86 mm i.d.) using a P97 Flaming/Brown micropipette puller (Sutter Instruments, Novato, Calif.). Spray voltages in the range of 1-2 kV were applied and the distance between the nanospray tip and the mass spectrometer inlet was set as 1.5 cm. The APCI protocol was implemented by applying a 4.4 kV DC to a stainless steel wire (0.21 mm ID, with its end 5 mm away from the DAPI inlet) to create corona discharge (Laughlin, B. C.; Mulligan, C. C.; Cooks, R. G. *Analytical Chemistry* 2005, 77, 2928-2939). The LTP probe consisted of a glass tube (o.d. 6.0 mm and i.d. 4.0 mm) with an axial grounded electrode (stainless steel; diameter, 1.6 mm) inside and a copper tape electrode wrapped around the outside tube surface (Harper, J. D.; Charipar, N. A.; Mulligan, C. C.; Zhang, X. R.; Cooks, R. G.; Ouyang, Z. *Analytical Chemistry* 2008, 80, 9097-9104). The end of the LTP probe was about 8 mm away from the DAPI inlet of the wand at a 35° angle from sample surface.

Methanol was obtained from Mallinckrodt Baker, INC. Methamphetamine, cocaine, atenolol, heroin, dimethyl methylphosphonate (DMMP) and diisomethyl methylphosphonate (DIMP) were purchased from Sigma Chemical Co. (Sigma-Aldrich, St. Louis, Mo.). Vapor-phase samples were diluted by injecting them into a flask using gas-tight syringes (Hamilton Company, Reno, Nev., USA) and then mixing them into a gas stream using a mass flow controller (model HFC-302, Teledyne Hasting Instruments, Hampton, Va., USA). Liquid sample solutions were prepared using 1:1 methanol/water for nano-ESI and pure methanol for LTP.

Example 3

Results

Figure 7A:
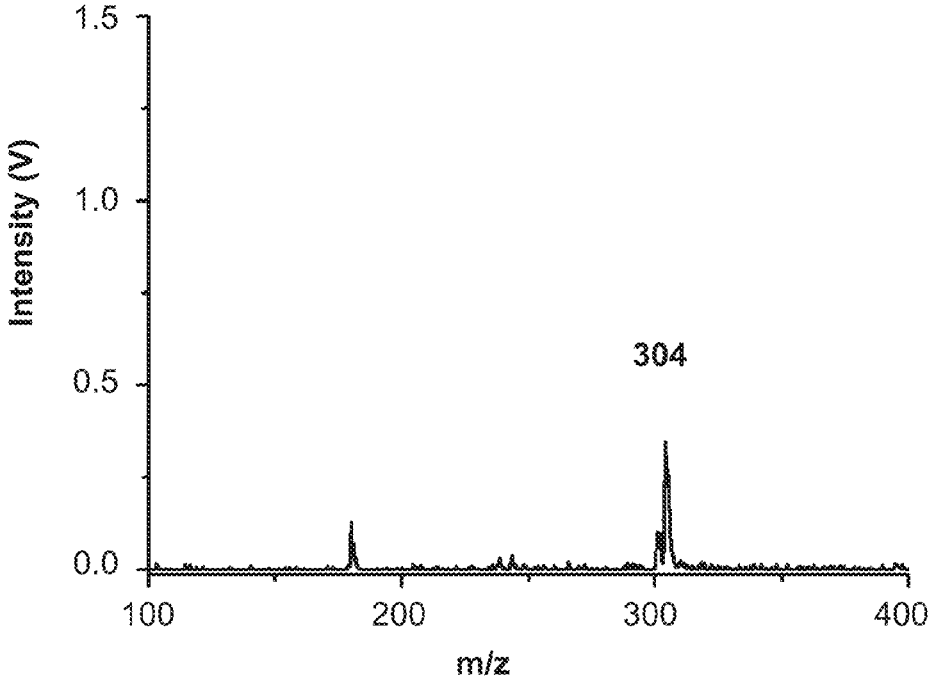
FIG. 7 is a mass spectra of 500 ppb cocaine solution recorded using (a) unmodified Mini 11 and (b) Mini 11 modified with the addition of a sampling wand. Both experiments use the same sample and the same nano-ESI tip for the ionization. Parts (c) and (d) show corresponding manifold pressures as a function of time, recorded using an ion gauge FIG. 8 (a) Mass spectra of a mixture of atenolol, cocaine and heroin, each at a concentration of 250 ppb, nano-ESI. Panel (b)-(d): MS/MS spectra for each analyte. Panel (e) and (f): calibration curves for cocaine and atenolol FIG. 9 Mass spectra recorded using APCI for the CWA simulants DMMP and DIMP, (a) 30 ppb DMMP and 300 ppb DIMP; (b) MS/MS data for 12 ppb DMMP.
Figure 7B:
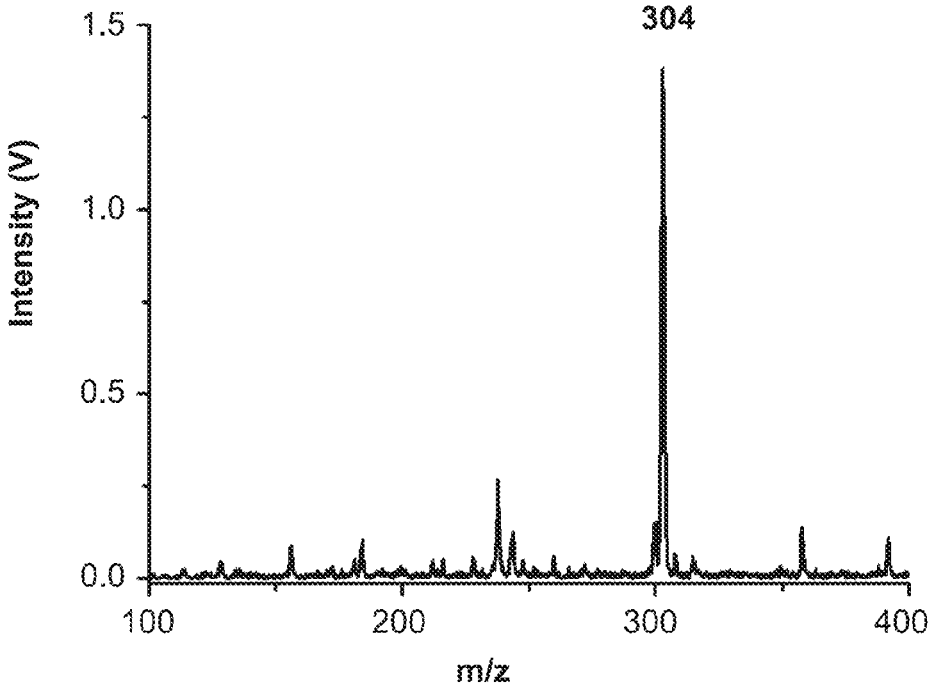

The Mini 11 with the new sampling wand was characterized using various ionization methods. Comparisons were made between mass spectra recorded by nano-ESI of 500 ppb cocaine solution using the original Mini 11 and the modified Mini 11 with the sampling wand (FIGS. 7*a* and *b*). The open time for the DAPI was 10 and 9 ms, respectively. In a significant contrast with the probes explored previously (Gao, L.; Sugiarto, A.; Harper, J. D.; Cooks, R. G.; Ouyang, Z. *Anal Chem* 2008, 80, 7198-7205), no loss in sensitivity was observed for the wand configuration, instead there was a three-fold improvement in signal and signal/noise ratio. In addition, no extra power was required as no auxiliary pumping or other devices were implemented to facilitate the improved ion transfer.

Figure 7C:
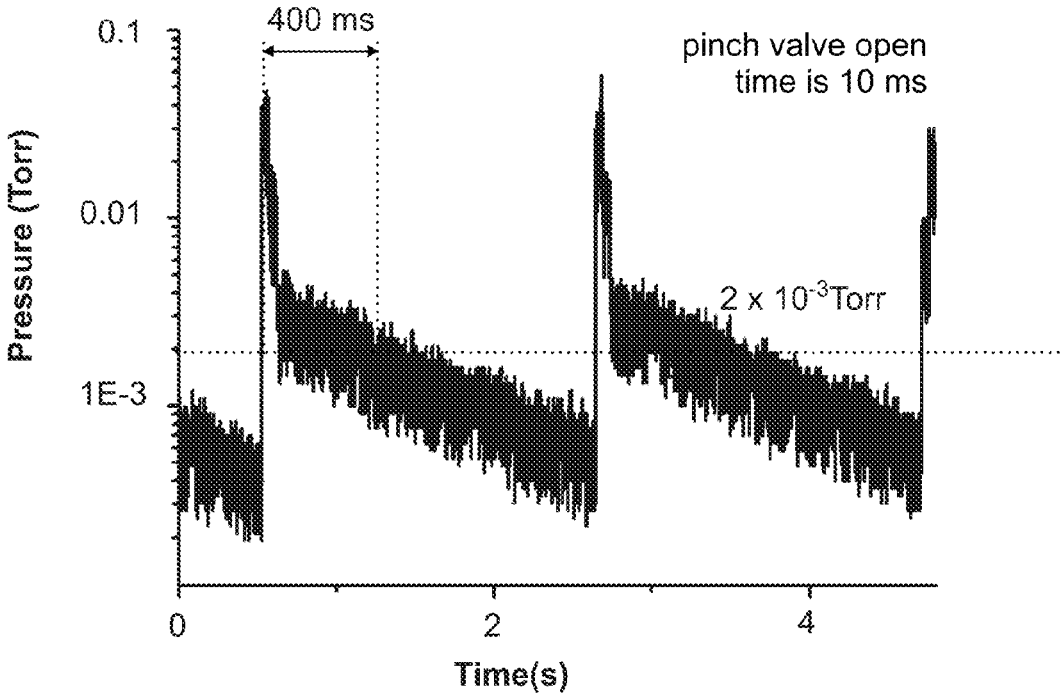
Figure 7D:
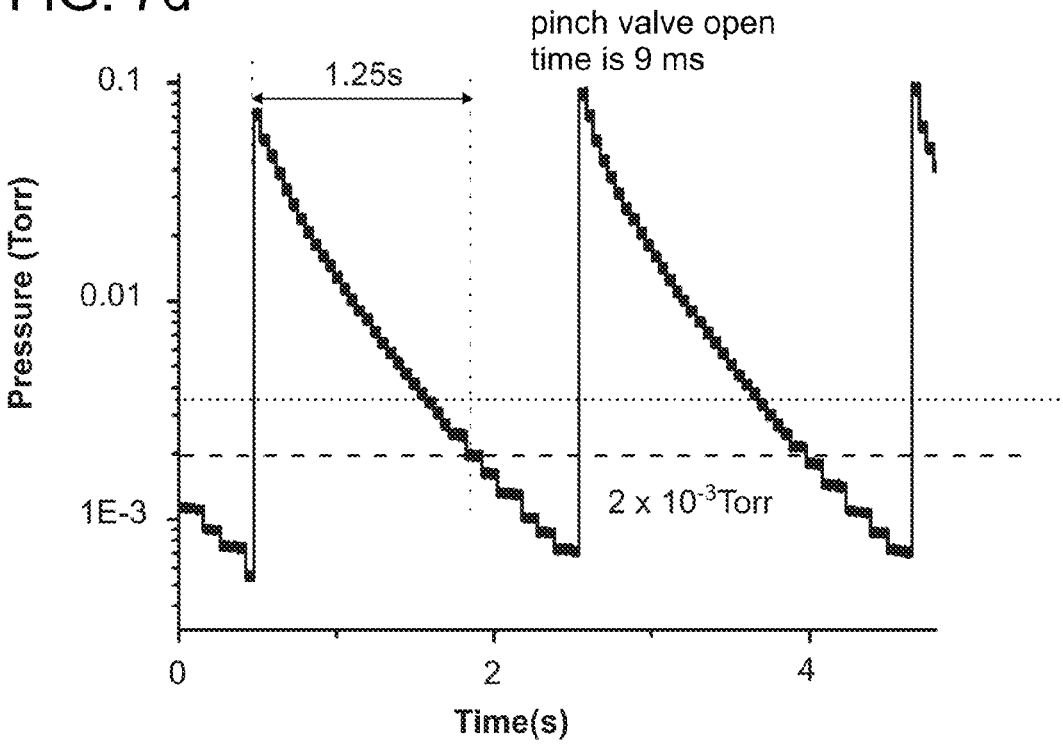
Figure 8A:
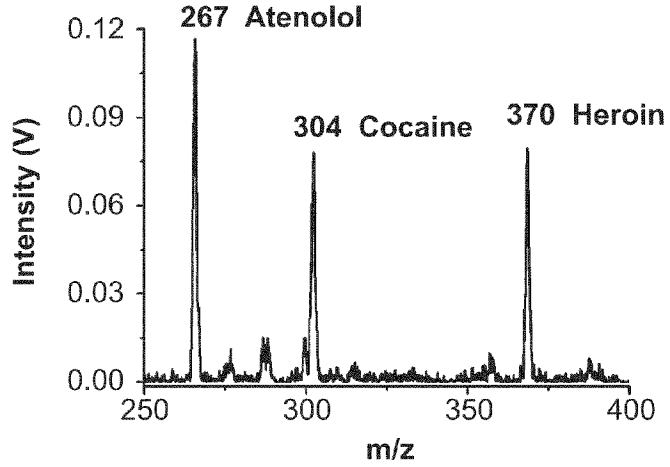
Figure 8B:
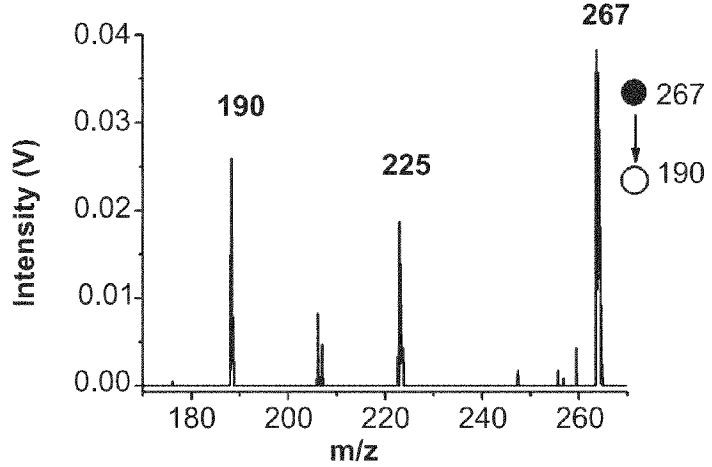
Figure 8C:
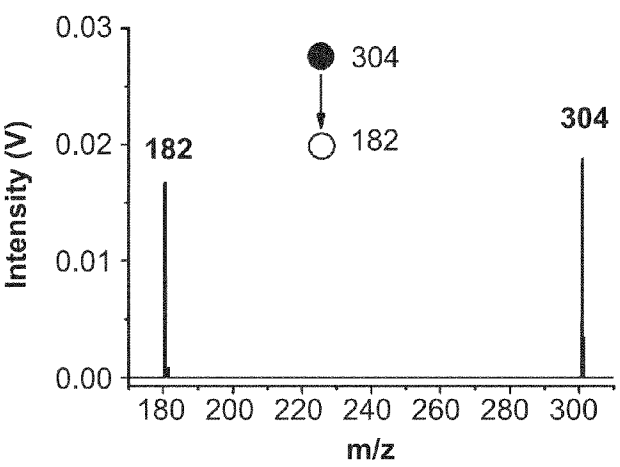
Figure 8D:
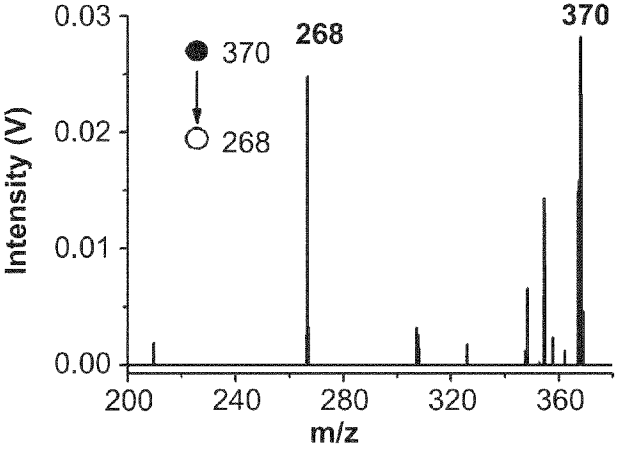

The signal improvement could be due to two factors, the enlarged vacuum system volume with the extension bellow tube and/or the increased ion transfer efficiency with a capillary of larger ID. Pressure variations during the operation were recorded, as shown in FIGS. 7*c* and *d*. Although the pressure varied within similar ranges for both configurations, more gas (3 times as much) containing ions was introduced into the vacuum with the wand configuration. With the 500 μm ID inlet capillary used for the wand, the mass flow rate was also much higher, which should help to improve the ion transfer through the DAPI. The observed improvement was only a factor of three, which might be due to the negative effects associated with larger gas expansion and greater ion speed. Under these conditions, decreased efficiency for the transfer of ions into the trap as well as their trapping is expected. It was observed that an increase in the RF voltage (e.g., 700Vp-p for the wand configuration vs. 350Vp-p for original Mini 11) during ion introduction significantly helped to increase signals. This change in RF amplitude also resulted in an increased low mass cutoff (LMCO) from m/z 60 to 92.

MS/MS represents an important capability for identifying target analytes in complex mixtures, especially for in situ work where chromatographic separation is not available. It does not only provide a higher level of confirmation of particular chemicals, but it also helps to improve the signal-to-noise ratio significantly by removing interfering ions before fragmentation of precursor ion (Chen, H.; Zheng, X. B.; Cooks, R. G. *Journal of the American Society for Mass Spectrometry* 2003, 14, 182-188; and Riter, L. S.; Meurer, E. C.; Handberg, E. S.; Laughlin, B. C.; Chen, H.; Patterson, G. E.; Eberlin, M. N.; Cooks, R. G. *Analyst* 2003, 128, 1112-1118). As described herein, precursor ions were isolated using a forward scan and reverse scan with resonance ejection of the ions in the lower and higher m/z ranges, respectively (Kaiser, R. E.; Cooks, R. G.; Syka, J. E. P.; Stafford, G. C. *Rapid Communications in Mass Spectrometry* 1990, 4, 30-33; and Schwartz, J. C.; Jaardine, I. *Rapid Communications in Mass Spectrometry* 1992, 6, 313-317); then collision-induced dissociation was implemented for fragmentation. The fragment ions were then mass analyzed by resonance ejection using a dipolar excitation at a q of 0.75 (AC=370 kHz, 1-2.0 $V_{0-p}$; Louris, J. N.; Cooks, R. G.; Syka, J. E. P.; Kelley, P. E.; Stafford, G. C.; Todd, J. F. J. *Analytical Chemistry* 1987, 59, 1677-1685). The MS and MS/MS spectra recorded for a mixture of cocaine, heroin, and atenolol are shown in FIG. 8. All these three analytes were present at a concentration of 250 ppb, and nano-ESI was used as the ionization method. Characteristic fragment ions were observed for each of these analytes.

Figure 8E:
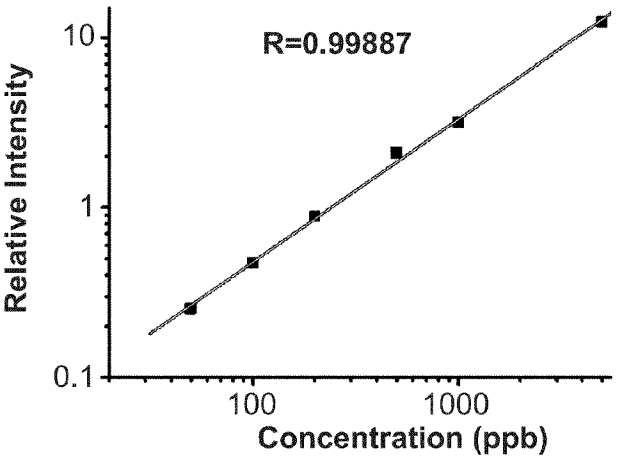
Figure 8F:
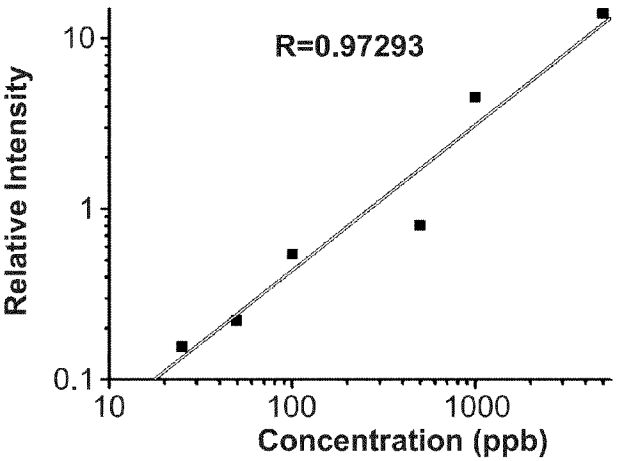

The linear dynamic range of this system, coupled with nano-ESI, was also characterized for the mixture of cocaine and atenolol within a concentration range from 10 ppb to 5 ppm. As shown in FIGS. 8*e* and *f*, good linearity was obtained between 50 ppb to 5 ppm for cocaine and 20 ppb to 5 ppm for atenolol.

Figure 9A:
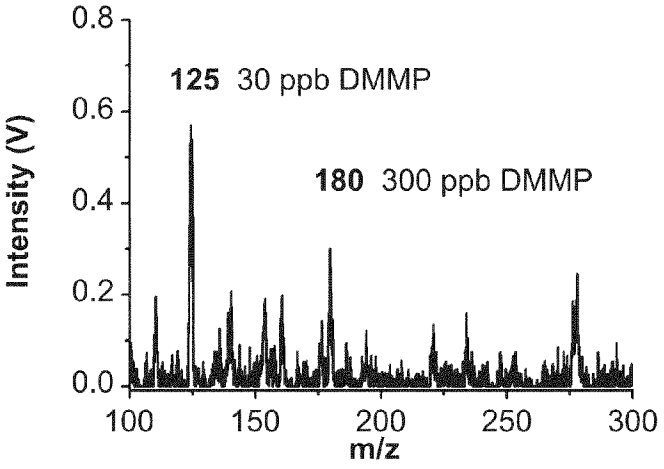
Figure 9B:
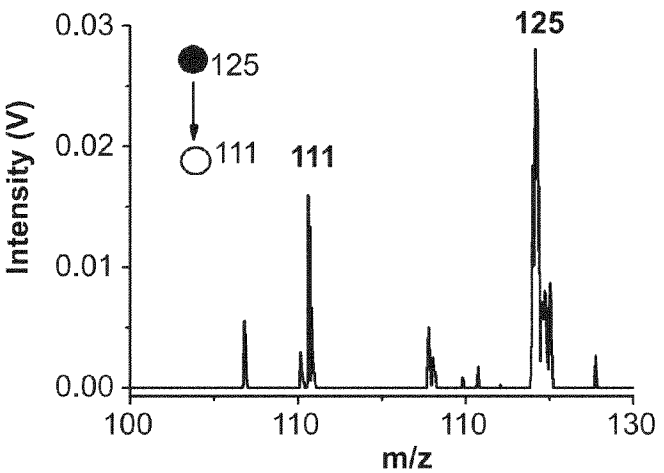

The feasibility of using the wand system for in-field chemical analysis was tested using APCI for gaseous samples and LTP for solid samples. Air samples containing the chemical warfare simulants DMMP (dimethyl methylphosphonate) and DIMP (diisomethyl methylphosphonate) were analyzed using the wand with APCI. The MS spectrum of mixture containing 30 ppb DMMP and 300 ppb DIMP is shown in FIG. 9*a*. A mass spectrum (not shown) recorded with 12 ppb DMMP has a signal/noise ratio of ca. 3, and the corresponding MS/MS spectrum (FIG. 9*b*) shows better signal-to-noise ratio for the protonated molecular ion m/z 125 and the product ion $[CH_3P(O)OCH_3+H_2O]^+$ at m/z 111.

Figure 10B:
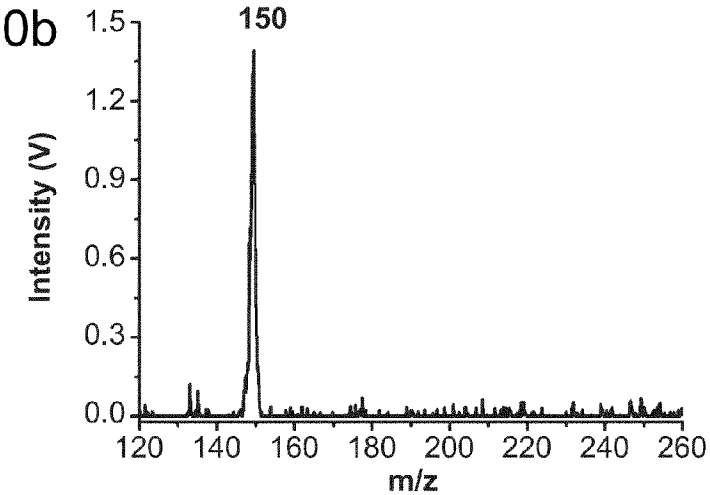
FIG. 10 Mass spectra of (a) 100 ng cocaine and (b) 100 ng methamphetamine on glass and MS/MS spectra of (c) 5 ng cocaine and (d) 1 ng methamphetamine on glass, LTP used for desorption ionization.
Figure 10A:
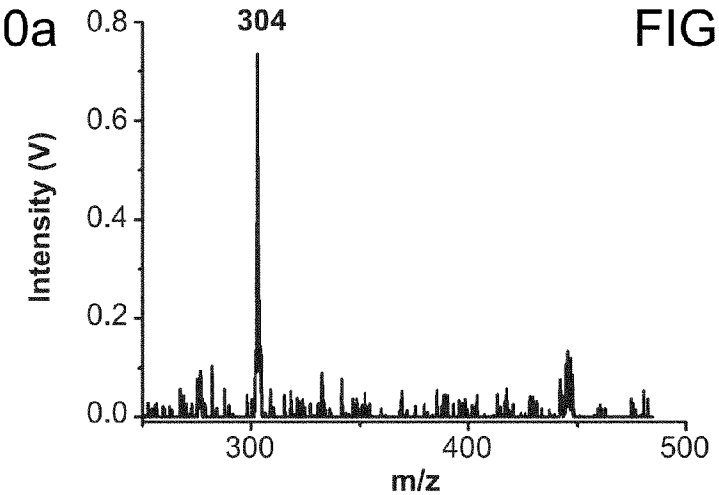
Figure 10D:
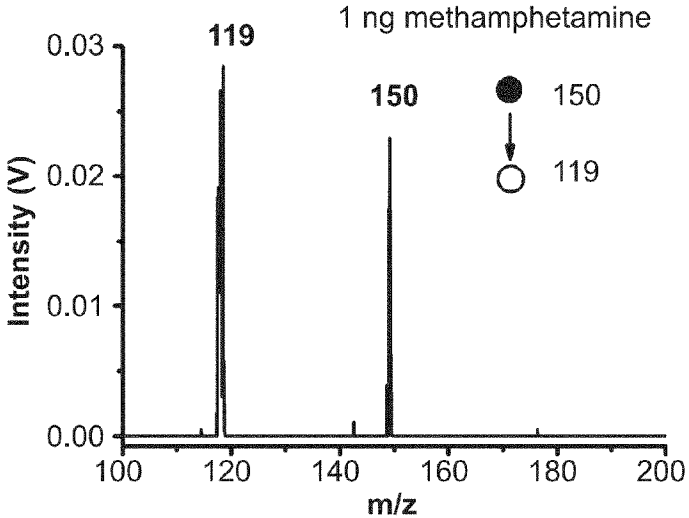
Figure 10C:
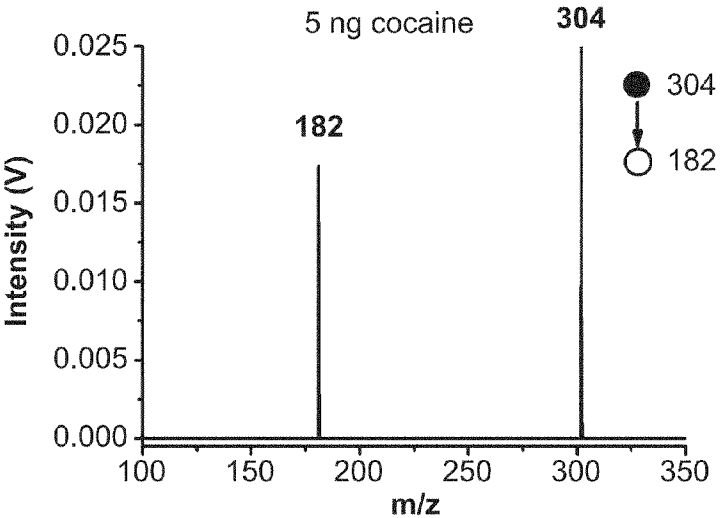

The direct analysis of solid samples using the wand system was tested using an LTP probe for desorption and ionization of cocaine and methamphetamine from a glass surface. The analytes were first dissolved in pure methanol and a selected amount was pipetted onto a glass slide and allowed to dry. Mass spectra were recorded for 100 ng cocaine and methamphetamine (FIGS. 10*a* and *b*, respectively), with good signal-to-noise ratios for the protonated molecular ions m/z 304 and m/z 150. Product ion MS/MS spectra with similar signal-to-noise ratios could be obtained with much smaller amounts of samples, as shown in FIG. 10*c* (5 ng cocaine) and FIG. 10*d* (1 ng methamphetamine).

What is claimed is:

1. A method for increasing the sensitivity of a mass spectrometer equipped with a discontinuous atmospheric pressure interface, the method comprising:

increasing vacuum volume of the mass spectrometer equipped with the discontinuous atmospheric pressure interface during ion introduction into the vacuum volume of the mass spectrometer.

2. The method according to claim 1, wherein the larger volume is achieved by using an elongated tube.

3. The method according to claim 2, wherein the tube is flexible.

4. The method according to claim 3, wherein the configuration is used to construct a sampling wand.

5. The method of according to claim 1, further comprising, analyzing a sample.

6. The method according to claim 5, wherein analyzing comprises:

ionizing a sample to generate ions of an analyte in the sample;

discontinuously transferring the ions into the mass spectrometer; and generating a mass spectrum of analytes in the sample.

7. The method according to claim 6, wherein the ionizing is by a technique selected from the group consisting of: electrospray ionization, nano-electrospray ionization, atmospheric pressure matrix-assisted laser desorption ionization, atmospheric pressure chemical ionization, desorption electrospray ionization, atmospheric pressure dielectric barrier discharge ionization, atmospheric pressure low temperature plasma desorption ionization, and electrospray-assisted laser desorption ionization.

8. The method according to claim 1, wherein the mass spectrometer is a benchtop or a handheld mass spectrometer.

9. The method according to claim 1, wherein the mass spectrometer comprises a mass analyzer.

10. The method according to claim 9, wherein the mass analyzer is selected from the group consisting of: a quadrupole ion trap, a rectalinear ion trap, a cylindrical ion trap, a ion cyclotron resonance trap, and an orbitrap.

11. A mass spectrometer equipped with a discontinuous atmospheric pressure interface having increased sensitivity produced by the process of:

increasing vacuum volume of the mass spectrometer equipped with the discontinuous atmospheric pressure interface during ion introduction into the vacuum volume of the mass spectrometer.

12. The mass spectrometer according to claim 11, wherein the increased volume is achieved by using an elongated tube.

13. The mass spectrometer according to claim 12, wherein the tube is flexible.

14. The mass spectrometer according to claim 13, wherein the configuration is used to construct a sampling wand.

15. The mass spectrometer of according to claim 11, further comprising an ionizing source.

16. The mass spectrometer according to claim 15, wherein the ionizing source operates by a technique selected from the group consisting of: electrospray ionization, nano-electrospray ionization, atmospheric pressure matrix-assisted laser desorption ionization, atmospheric pressure chemical ionization, desorption electrospray ionization, atmospheric pressure dielectric barrier discharge ionization, atmospheric pressure low temperature plasma desorption ionization, and electrospray-assisted laser desorption ionization.

17. The mass spectrometer according to claim 11, wherein the mass spectrometer is a benchtop or a handheld mass spectrometer.

18. The mass spectrometer according to claim 11, wherein the mass spectrometer comprises a mass analyzer.

19. The mass spectrometer according to claim 18, wherein the mass analyzer is selected from the group consisting of: a quadrupole ion trap, a rectalinear ion trap, a cylindrical ion trap, a ion cyclotron resonance trap, and an orbitrap.

* * * * *